US006141827A

United States Patent [19]

Wu

[11] Patent Number: 6,141,827

[45] Date of Patent: Nov. 7, 2000

[54] CARRIER SLIDES FOR WINDOW COVERINGS WITH STUCK PREVENTION

[75] Inventor: Junn Ming Wu, Kaohsiung, Taiwan

[73] Assignee: Bao Song Precision Industry Co., Ltd., Kaohsiung, Taiwan

[21] Appl. No.: 09/153,890

[22] Filed: Sep. 16, 1998

[51] Int. Cl.[7] ..... A47H 15/00

[52] U.S. Cl. ..... 16/91; 16/960; 16/106

[58] Field of Search ..... 16/91, 87.2, 87.4 R, 16/87.6 R, 96 D, 106; 160/166.1, 178.1, 201, 900, 345, 346

[56] References Cited

U.S. PATENT DOCUMENTS

| | | | |
|---|---|---|---|
| 1,692,632 | 11/1928 | Dickey | 16/91 |
| 2,633,088 | 3/1953 | King | 16/106 |
| 3,337,903 | 8/1967 | Kenney | 16/87.4 |
| 3,580,183 | 5/1971 | Nearman | 104/111 |
| 4,473,102 | 9/1984 | Ohman et al. | 160/345 |
| 5,275,221 | 1/1994 | Doehlemann | 160/84.1 E |
| 5,542,149 | 8/1996 | Yu | 16/87.4 |
| 5,970,578 | 10/1999 | Mensching et al. | 16/94 R |
| 5,975,187 | 11/1999 | Chou | 160/345 |

FOREIGN PATENT DOCUMENTS

| | | | |
|---|---|---|---|
| 240422 | 2/1995 | Taiwan . | |
| 420279 | 11/1934 | United Kingdom | 16/87.6 |

*Primary Examiner*—Anthony Knight
*Assistant Examiner*—Alison K. Pickard
*Attorney, Agent, or Firm*—Bacon & Thomas

[57] ABSTRACT

A carrier slide is provided for window coverings and includes a main body, at least one vertical roller assembly, and at least one horizontal roller assembly. The main body includes at least one compartment defined therein. At least one vertical hole is defined in an upper end thereof and communicated with the compartment, and at least one transverse hole is defined in the upper side thereof. The vertical roller assembly includes a first roller rotatably received in the compartment. The first roller has a diameter greater than a width of the main body and smaller than a width of a track so as to be in a rolling contact with two inner lateral walls of the track. The horizontal roller assembly includes a second roller rotatably attached to a lateral side of the main body. The second roller is in a rolling contact with the inner face of the bottom wall of the track.

4 Claims, 5 Drawing Sheets

CARRIER SLIDES FOR WINDOW COVERINGS WITH STUCK PREVENTION

BACKGROUND OF THE INVENTION

1. Field of the Invention

The present invention relates to improved carrier sliders for window coverings with stuck prevention.

2. Description of the Related Art

A conventionally window curtain or the like is stringed with a cord at an upper side thereof to allow "opening" and "closing" of the curtain. After a long-term use, the curtain surface will be worn out due to friction and thus result in sticking and/or breakage of the curtain. Tracks and carrier slides are provided to smoothly carry the curtain under easy operation, yet the rollers on the carrier slides have a relatively short life of period due to friction.

Taiwan Utility Model Publication No. 240422 discloses an improved carrier slide that has a plurality of rollers mounted to both lateral sides of a body thereof and a restraining roller mounted to each of a front end and a rear end of the body for eliminating deviation in the horizontal direction and vertical direction and for converting sliding motions into rolling motions so as to lengthen the period of life and to provide a smoother operation. Nevertheless, manufacture of such a carrier slide is troublesome and costly, as there are ten rollers on the carrier slide. In addition, installation of the restraining rollers is difficult, as they are parallel to the body and sandwiched between two lateral sides of the track. Furthermore, the body must be increased in the length thereof for installation of the restraining rollers. The overall width of the track is also increased and thus results in an increased cost. The present invention is intended to provide improved carrier slides to solve these problems.

SUMMARY OF THE INVENTION

It is a primary object of the present invention to provide an improved carrier slide that has a simpler structure for ease of manufacture and assembly.

It is another object of the present invention to provide a carrier slide that has a relatively small width and thus requires a track of a smaller width to thereby occupy a smaller space and reduce the cost.

In accordance with the present invention, a carrier slide is provided for window coverings. The carrier slide, being adapted to slide along a track having two inner lateral walls and a bottom wall with an inner face and an outer face, comprises a main body, at least one vertical roller assembly, and at least one horizontal roller assembly. The main body includes at least one compartment defined therein. At least one vertical hole is defined in an upper end thereof and communicated with the compartment, and at least one transverse hole is defined in the upper side thereof The vertical roller assembly includes a first roller rotatably received in the compartment and having a vertical axis. The first roller has a diameter greater than a width of the main body and smaller than a width of the track so as to be in a rolling contact with the inner lateral walls of the track. A first axle pin is extended through the vertical hole for rotatably supporting the first roller. The first axle pin includes an enlarged head for preventing disengagement of the first roller.

The horizontal roller assembly includes a second roller rotatably attached to one of two lateral sides of the main body and having an axial hole extended in a direction transverse to a longitudinal direction of the main body. A second axle pin is extended through the axial hole of the second roller for rotatably supporting the second roller. The second axle pin has an enlarged head for preventing disengagement of the second roller. The second roller is in a rolling contact with the inner face of the bottom wall of the track.

The main body may further comprise a receptacle defined below the compartment and communicated with the compartment via a narrowed passage. The first axle pin has a snapping end that is passable through the vertical hole and the narrowed passage and rotatably retained in the receptacle.

The second roller may be conic and include a conic recess defined in an outer side thereof for receiving the enlarged head of the second axle pin.

A third roller may be mounted on top of the main body and rotatably mounted around the first axle pin.

A further roller may be rotatably mounted to the other lateral side of the main body by an axle pin. This roller is in a rolling contact with the outer face of the bottom wall of the track.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
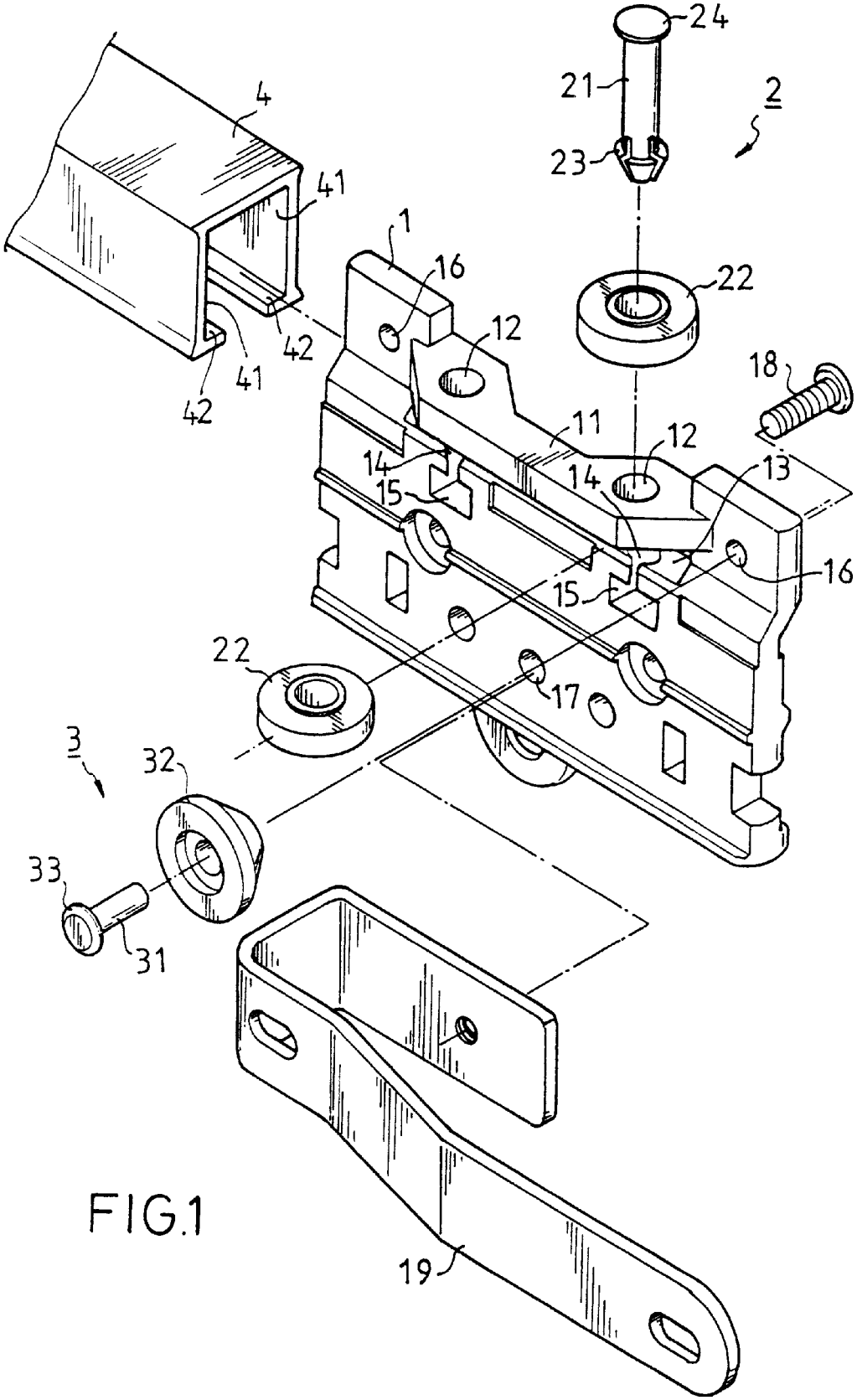
FIG. 1 is an exploded perspective view of a carrier slide in accordance with the present invention and a track therefor.
Figure 2:
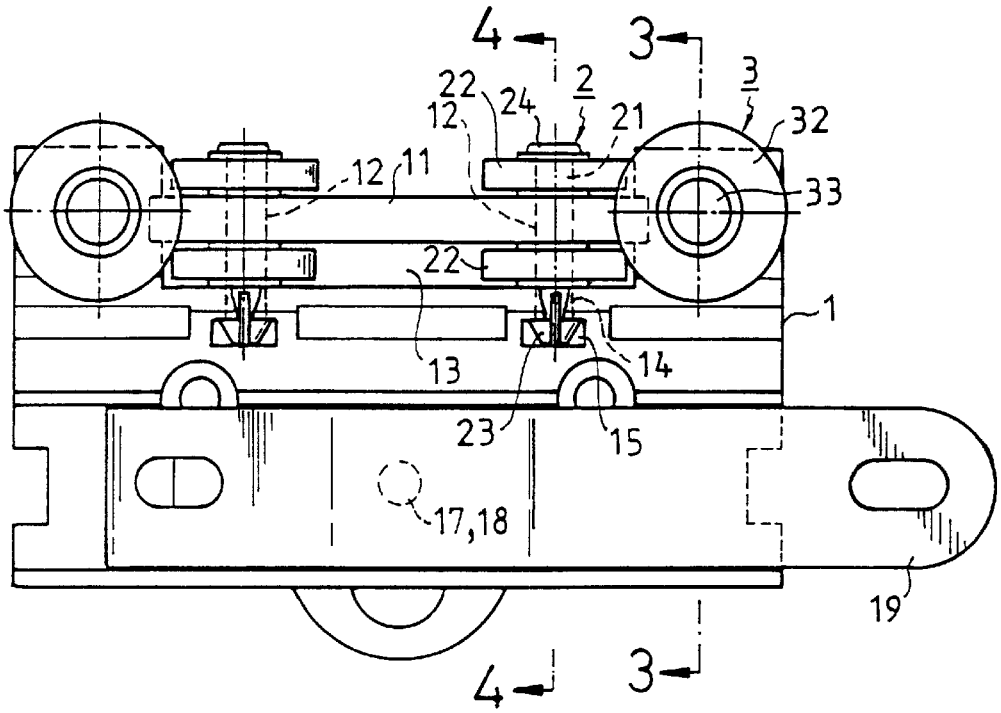
FIG. 2 is a side view of the carrier slide.
Figure 5:
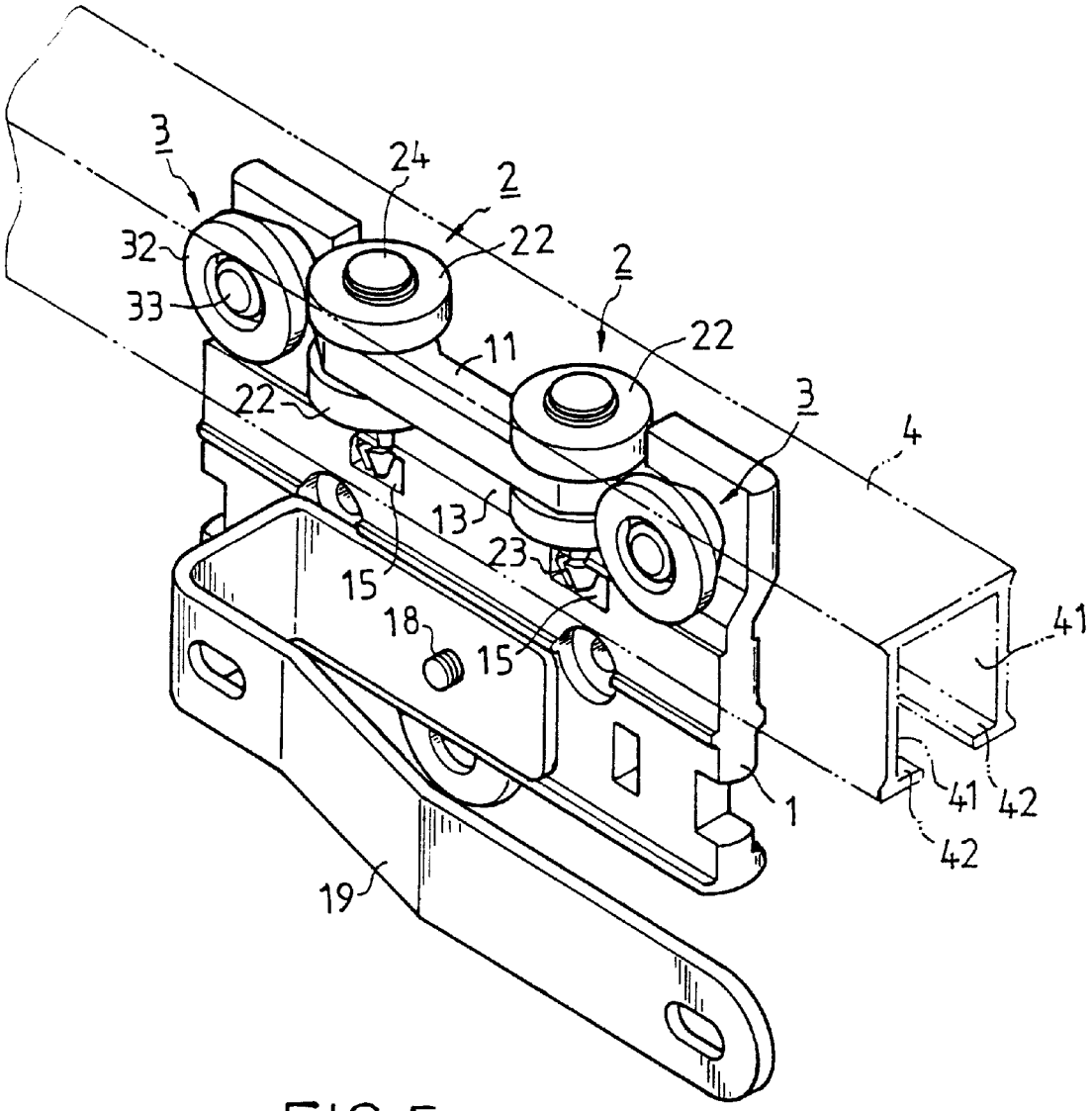
FIG. 5 is a perspective view of the carrier slide in accordance with the present invention.

Referring to FIGS. 1, 2, and 5, a carrier slide for window coverings in accordance with the present invention generally includes a main body 1, at least one vertical roller assembly 2, and at least one horizontal roller assembly 3. The main body 1 includes at least one compartment 13 defined therein. A vertical hole 12 is defined in an upper end of the main body 1 and communicates with the compartment 13. Below the compartment 13 a receptacle 15 is defined and communicated with the compartment 13 via a narrowed passage 14.

Figure 4:
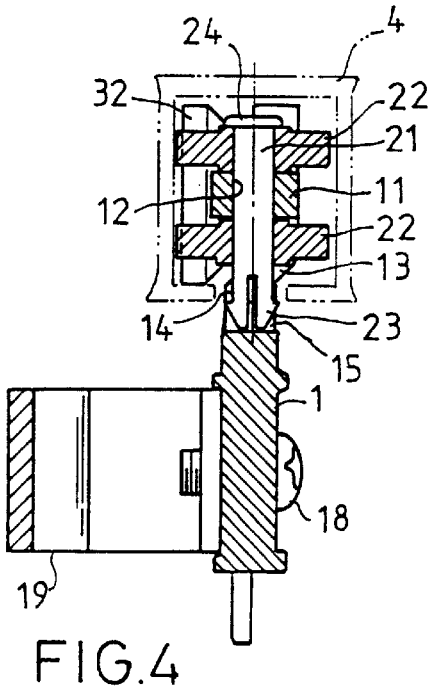
FIG. 4 is a sectional view taken along line 4—4 in FIG. 2.

The vertical roller assembly 2 includes a roller 22 rotatably received in the compartment 13 and having a vertical axis. The roller 22 has a diameter greater than a width of the main body 1 and smaller than a width of a track 4 so as to be in a rolling contact with two inner lateral walls 41 of the track 4. The roller assembly 2 further includes an axle pin 21 having a snapping end 23 that can be passed through the vertical hole 12 and narrowed passage 14 and then rotatably retained in the receptacle 15. The axle pin 21 includes an enlarged head 24 for preventing disengagement of the roller 22. In addition, as shown in FIGS. 2 and 4, a further roller 22 may be mounted on top of the main body 1 and rotatably mounted around the axle pin 21.

The main body 1 further includes at least one transverse hole 16 defined in the upper end thereof The horizontal roller assembly 3 includes a roller 32 rotatably attached to a side of the main body 1 by means of extending an axle pin 31 through an axial hole (not labeled) of the roller 32. The axial hole of the roller 32 extends in a direction transverse to the longitudinal direction of the main body 1. The roller 32 may be conic and includes a conic recess (not labeled) defined in an outer side thereof for receiving an enlarged head 33 of the axle pin 31. Provision of the enlarged head 33 of the axle pin 31 may prevent disengagement of the roller 32.

Still referring to FIG. 1, the main body 1 includes a number of positioning holes 17 defined in a lower end thereof A hanger rod 19 is attached to one of the holes 17 by a screw 18, and a window covering (not shown) is attached to the hanger rod 19, which is conventional and therefore not further described.

In this embodiment, there are two vertical roller assemblies 2 and two horizontal vertical roller assemblies 3, and the main body 1 includes a corresponding number of holes 12 and 16, narrowed passages 14, and receptacles 15.

Figure 3:
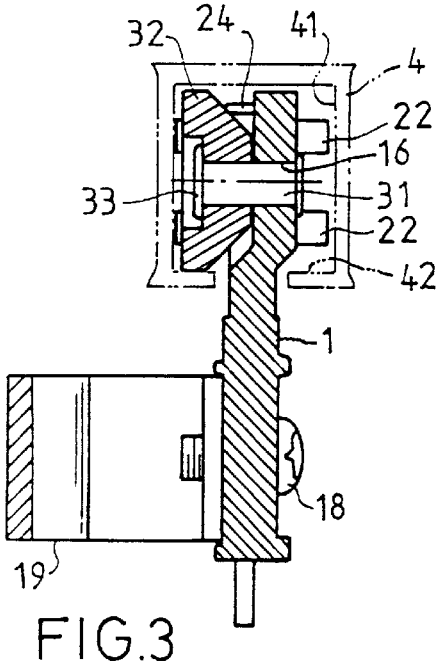
FIG. 3 is a sectional view taken along line 3—3 in FIG. 2.

In use, the roller 32 may roll along an inner face 42 (FIG. 1) of a bottom wall (not labeled) of the track 4, as shown in FIG. 3. In addition, as shown in FIG. 4, the rollers 22 may roll along at least one of the inner lateral walls 41 of the track 4. Accordingly, the carrier slide may slide smoothly along the track 4.

Figure 6:
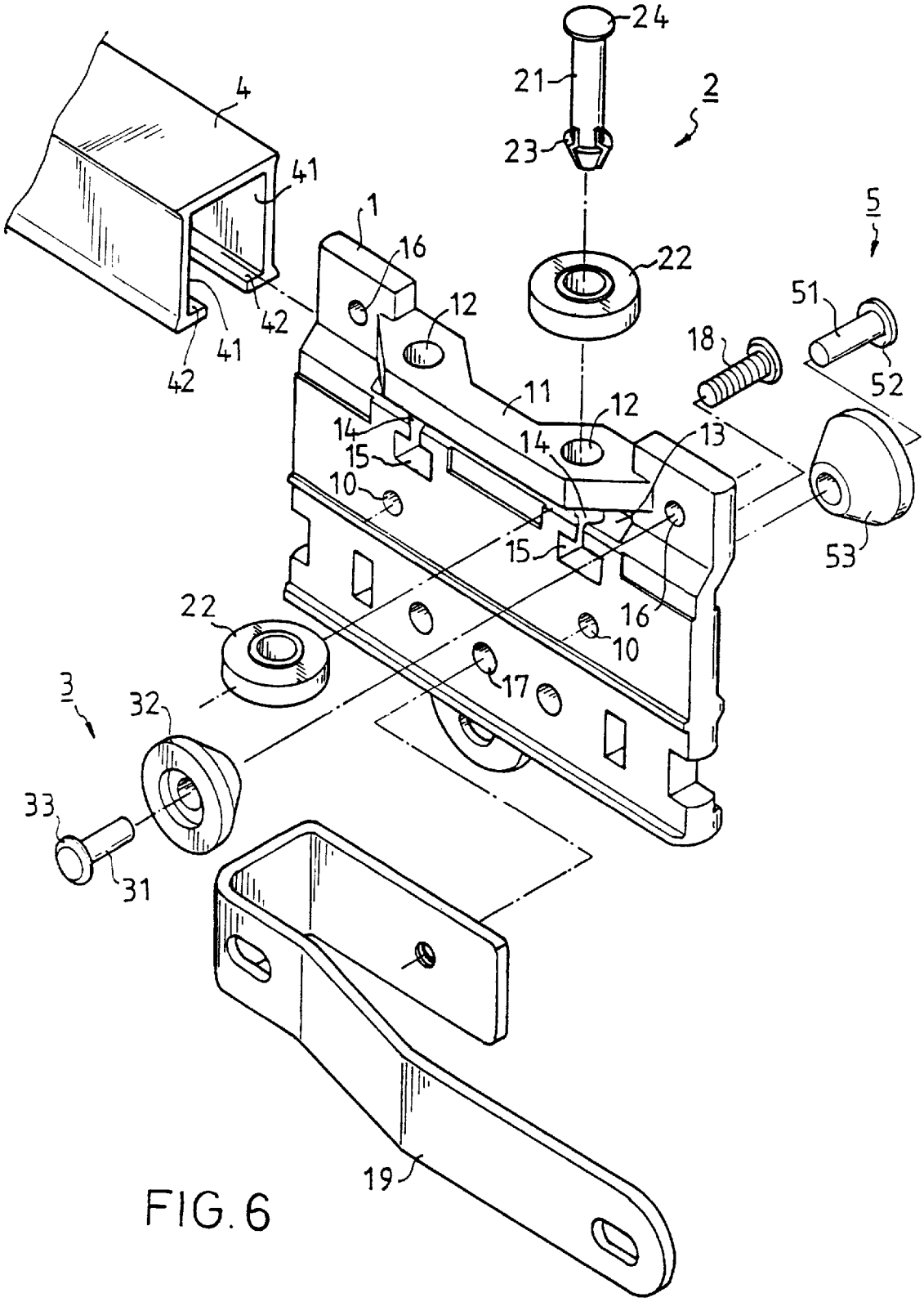
FIG. 6 is an exploded perspective view of a second embodiment of the carrier slide in accordance with the present invention and a track therefor.
Figure 7:
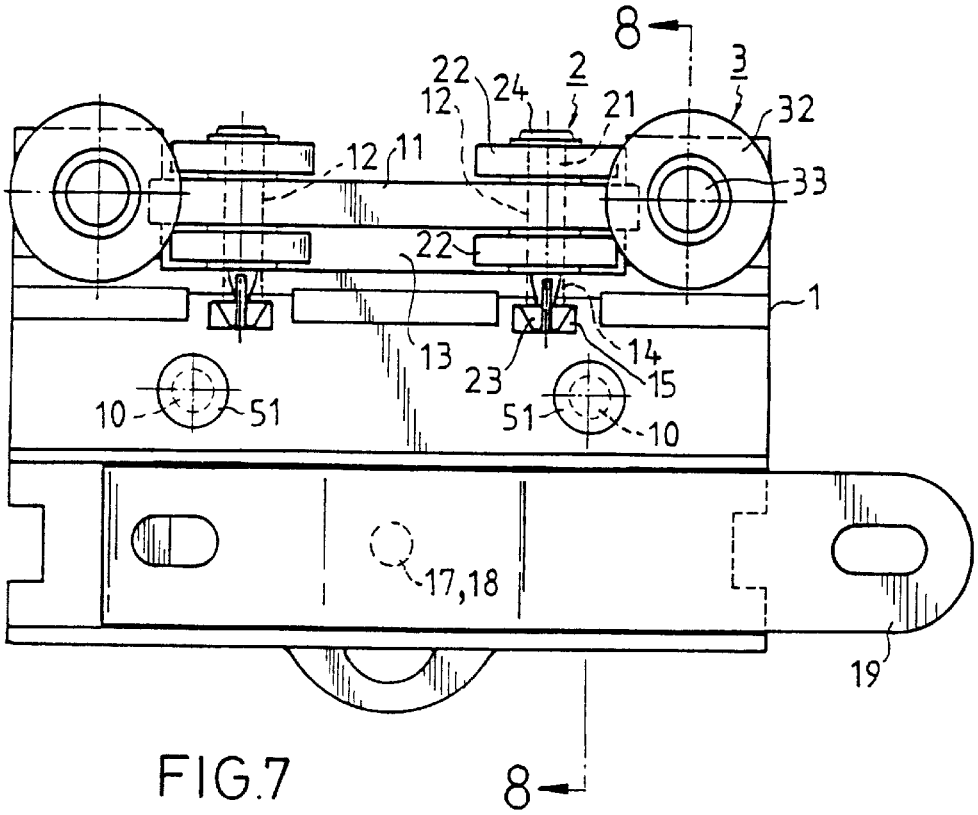
FIG. 7 is a side view of the carrier slide in FIG. 6.
Figure 8:
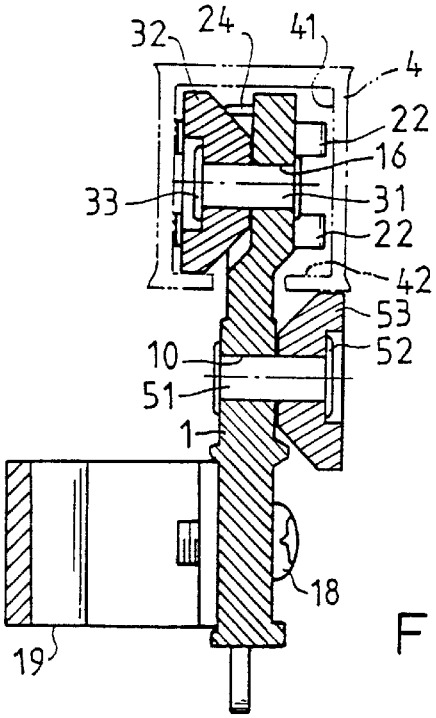
FIG. 8 is a sectional view taken along line 8—8 in FIG. 7.

FIGS. 6 and 7 illustrate a second embodiment of the carrier slide of the present invention, in which an additional roller assembly 5 is provided. The roller assembly 5 includes a roller 53 rotatably mounted to the other side of the main body 1 by an axle pin 51. The roller 53 may roll along an outer face of the bottom wall of the track 4, best shown in FIG. 8. The axle pin 51 may include an enlarged head 52 to prevent disengagement of the roller 52.

According to the above description, it is appreciated that the number of the rollers of the carrier slide of the present invention is reduced when compared with the conventional design without adversely affecting the friction-reducing effect. In addition, the overall length and width of the main body 1 and the cost therefor can be reduced.

Although the invention has been explained in relation to its preferred embodiment, it is to be understood that many other possible modifications and variations can be made without departing from the spirit and scope of the invention as hereinafter claimed.

What is claimed is:

1. A carrier slide for window coverings, the carrier slide being adapted to slide along a track having two inner lateral walls and a bottom wall with an inner face and an outer face, the carrier slide comprising:

a main body including at least one compartment defined therein, at least one vertical hole defined in an upper end thereof and communicated with said at least one compartment, and at least one transverse hole defined in an upper side thereof, the main body further including two lateral sides, a receptacle defined below said at least one compartment and communicating with said at least one compartment through a narrowed passage, at least one vertical roller assembly including a first roller rotatably received in said at least one compartment and having a vertical axis, the first roller having a diameter greater than a width of the main body and smaller than a width of the track so as to be in a rolling contact with the inner lateral walls of the track, and a first axle pin extended through said at least one vertical hole for rotatably supporting the first roller, the first axle pin including an enlarged head for preventing disengagement of the first roller and a snapping end that is passable through said at least one vertical hole and the narrowed passage and rotatably retained in the receptacle, and at least one horizontal roller assembly including a second roller rotatably attached to one of the lateral sides of the main body and having an axial hole extended in a direction transverse to a longitudinal direction of the main body, and a second axle pin extended through the axial hole of the second roller for rotatably supporting the second roller, the second axle pin having an enlarged head for preventing disengagement of the second roller, the second roller being in a rolling contact with the inner face of the bottom wall of the track.

2. The carrier slide as claimed in claim 1, wherein the second roller is conic and includes a conic recess defined in an outer side thereof for receiving the enlarged head of the second axle pin.

3. The carrier slide as claimed in claim 1, further comprising a third roller mounted on top of the main body and rotatably mounted around the first axle pin.

4. The carrier slide as claimed in claim 1, wherein the main body further comprises a third roller rotatably mounted to the other of the lateral sides thereof by a third axle pin, the third roller being in a rolling contact with the outer face of the bottom wall of the track, the third axle pin including an enlarged head to prevent disengagement of the third roller.

* * * * *